US005122833A

United States Patent [19]

Sato

[11] Patent Number: 5,122,833

[45] Date of Patent: Jun. 16, 1992

[54] COPIER CAPABLE OF DETECTING DOCUMENT SIZE

[75] Inventor: Takako Sato, Yokohama, Japan

[73] Assignee: Ricoh Company, Ltd., Tokyo, Japan

[21] Appl. No.: 774,998

[22] Filed: Oct. 11, 1991

[30] Foreign Application Priority Data

Oct. 12, 1990 [JP] Japan ..... 2-274761
May 17, 1991 [JP] Japan ..... 3-142372

[51] Int. Cl.[5] ..... G03G 21/00

[52] U.S. Cl. ..... 355/203; 355/75; 355/230; 355/311

[58] Field of Search ..... 355/75, 230, 231, 311, 355/203, 204, 68; 250/557, 560

[56] References Cited

U.S. PATENT DOCUMENTS 3,914,049 10/1975 Basu et al. ..... 355/68
4,511,246 4/1985 Nishiyama ..... 355/75
5,016,049 5/1991 Onishi et al. ..... 355/203

*Primary Examiner*—A. T. Grimley
*Assistant Examiner*—William J. Royer
*Attorney, Agent, or Firm*—Oblon, Spivak, McClelland, Maier & Neustadt

[57] ABSTRACT

A copier having a platen for laying a document thereon and a platen cover having the inner surface thereof implemented as a mirror surface or similar reflective surface for covering the platen and document, and capable of detecting the size of the document by illuminating the reflective surface of the platen cover and the document, reading the resulting reflections from the platen cover and document, and discriminating the platen cover and document on the basis of data representative of the reflections. Since the density of the reflective surface of the platen cover associated with the area outside of an effective image area changes with the angle of the platen cover, i.e., the thickness of the document, an optimal parameter matching the inclination angle of the platen cover is selected to compensate for the change in density. Even the size of a relatively thick document is surely detected with no regard to the position of the platen cover.

6 Claims, 9 Drawing Sheets

Fig. 7

| PARAMETER IV (ANGLE θ) | PARAMETER I (6 BITS) | PARAMETER II (6 BITS) |
|---|---|---|
| 0 | 35 | 40 |
| 6 | 30 | 35 |
| 10 | 25 | 30 |
| 16 | 19 | 24 |
| 20 | 16 | 21 |
| 24 | 11 | 16 |
| 30 | 8 | 13 |
| 35 | 7 | 12 |
| 40 | 5 | 10 |

Fig. 10

| ANGLE θ | OUTSIDE DATA |
|---|---|
| 0 | 55 |
| 6 | 50 |
| 10 | 45 |
| 16 | 39 |
| 20 | 36 |
| 24 | 31 |
| 30 | 28 |
| 35 | 27 |
| 40 | 25 |

COPIER CAPABLE OF DETECTING DOCUMENT SIZE

BACKGROUND OF THE INVENTION

The present invention relates to a copier capable of detecting the size of a document laid on a platen thereof. More particularly, the present invention is concerned with a copier having a platen and a platen cover whose inner surface is implemented as a mirror surface or similar reflectvie surface for, and capable of detecting the size of the document by illuminating the document and the reflective surface of the platen covering the document, reading the resulting reflections from the platen cover and document, and discriminating the platen cover and document on the basis of the read information.

It has been customary with a copier, particularly electrophotographic copier, for the operator to lay a document on a platen in a particular position matching the size of the document, cover the document by a platen cover, select one of cassettes each being loaded with sheets of particular size (e.g. A4, B3 or B5) matching a desired magnification change ratio, and then press a print button. Then, the copier starts on a sequence of copying steps. Specifically, a scanner disposed below a platen scans the document, and the resulting reflection from the document is focused into the surface of a photoconductive element to electrostatically form a latent image. The latent image is developed by a toner or similar developer stored in a developing device and then transported to an image transfer station. A sheet fed out from the cassette having been selected and waiting at a predetermining position is driven toward the image transfer station at a predetermined timing, whereby the developed image or toner image is tranferred from the photoconductive element to the sheet. The toner image on the sheet is fixed by a fixing device.

The above-described type of copier will readily reproduce even a book or similar relatively thick document if the platen cover is fully opened. This is undesirable, however, since the light directly reaching the operator's eye from the scanner is harmfful and since light entering the interior of the copier from the outside via the platen adversely obstructs accurate image reading operation. It is, therefore, necessary that the platen cover be closed even when such a thick document is reproduced.

To detect the size of a document laid on the platen, use may be made of a platen cover whose inner surface is implemented as a mirror surface or similar reflective surface. After such a platen cover has been lowered to cover the platen and a document laid thereon, the mirror surface and the document are illuminated. The resulting reflections from the mirror surface and document are incident to a CCD (Charge Coupled Device) image sensor or similar image sensor. As a result, the document portion and the cover portion are discriminated from each other, i.e., the size of the document is determined, on the basis of information having been read. While this kind of implementation is useful when the document is in the form of a sheet, it cannot accurately detect the size of a document with no regard to the thickness of the document since relatively thick documents such as books each has a different thickness.

SUMMARY OF THE INVENTION

It is, therefore, an object of the present invention to provide a copier capable of detecting the size of a document with accuracy even if the document is a book or similar thick document.

It is another object of the present invention to provide a generally improved copier capable of detecting the size of a document.

In accordance with the present invention, in a copier having a platen for laying a document thereon and a platen cover having the inner surface thereof implemented as a mirror surface or similar reflective surface for covering the platen and document, and capable of detecting the size of the document by illuminating the reflective surface of the platen cover and the document, reading the resulting reflections from the platen cover and document, and discriminating the platen cover and document on the basis of read data representative of the reflections, there are provided an angle detection circuit for detecting the inclination angle of the platen cover relative to the platen, and a parameter setting circuit for changing, in response to the detected inclination angle, a parameter to be used for the detection of a document size.

BRIEF DESCRIPTION OF THE DRAWINGS

The above and other objects, features and advantages of the present invention will become more apparent from the following detailed description taken with the accompanying drawings in which:

FIG. 7 is a table listing parameters stored in a memory built in a system controller shown in FIG. 4.

FIG. 10 is a table listing data meant for the area outside the effective image area and stored in an outside data generating section shown in FIG. 8.

DESCRIPTION OF THE PREFERRED EMBODIMENT

To better understand the present invention, a brief reference will be made to a conventional method of determining the size of a document, shown in FIG. 1. A conventional copier capable of detecting a document size has a platen cover whose inner surface is implemented as a mirror surface or similar reflective surface.

After the platen cover has been lowered to cover a platen provided on the top of the copier and a document laid on the platen, light illuminates the reflective surface of the platen cover and the document. The resulting reflections from the platen cover and document are incident to a CCD image sensor or similar image sensor. As a result, the document and the platen cover are discriminated from each other to determine the size of the document. Specifically, as shown in FIG. 1, when the density in the main scanning direction represented by the output of a scanner is higher than a predetermined value (46 in this example), it is determined to represent the platen cover. In this case, it is necessary to use a threshold that maintains the difference between data remote from each other by a predetermined distance greater than a predetermined value. Such a conventional scheme has a problem left unsolved, as follows. Assume that a light source for the illumination is implemented as a planar light source having a stable spectral distribution characteristic. Then, when the thickness of the document is changed, it is impossible for the density of the platen cover to be read in a predetermined range at all times. Therefore, considering thick documents, the above-mentioned threshold level has to be lowered. This, however, would reduce the range in which the density level of the edge of a document can be sensed.

Figure 2:
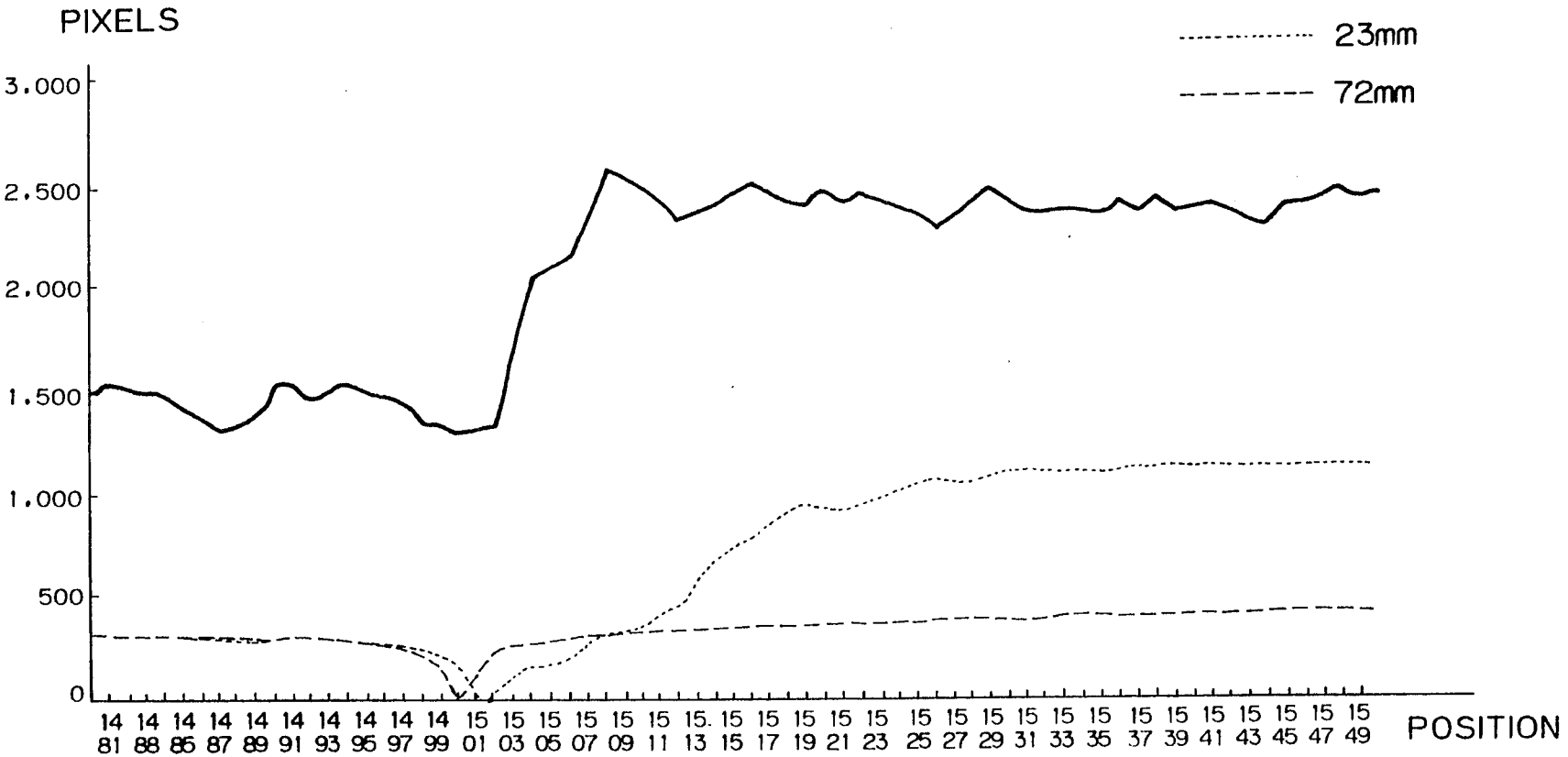
Fig. 2 PRIOR ART
FIG. 2 is a graph showing a relation between the number of pixels on one line and the position in the subscanning direction in the vicinity of the boundary between a document and a platen cover, with respect to a threshold greater than 32.
Figure 3:
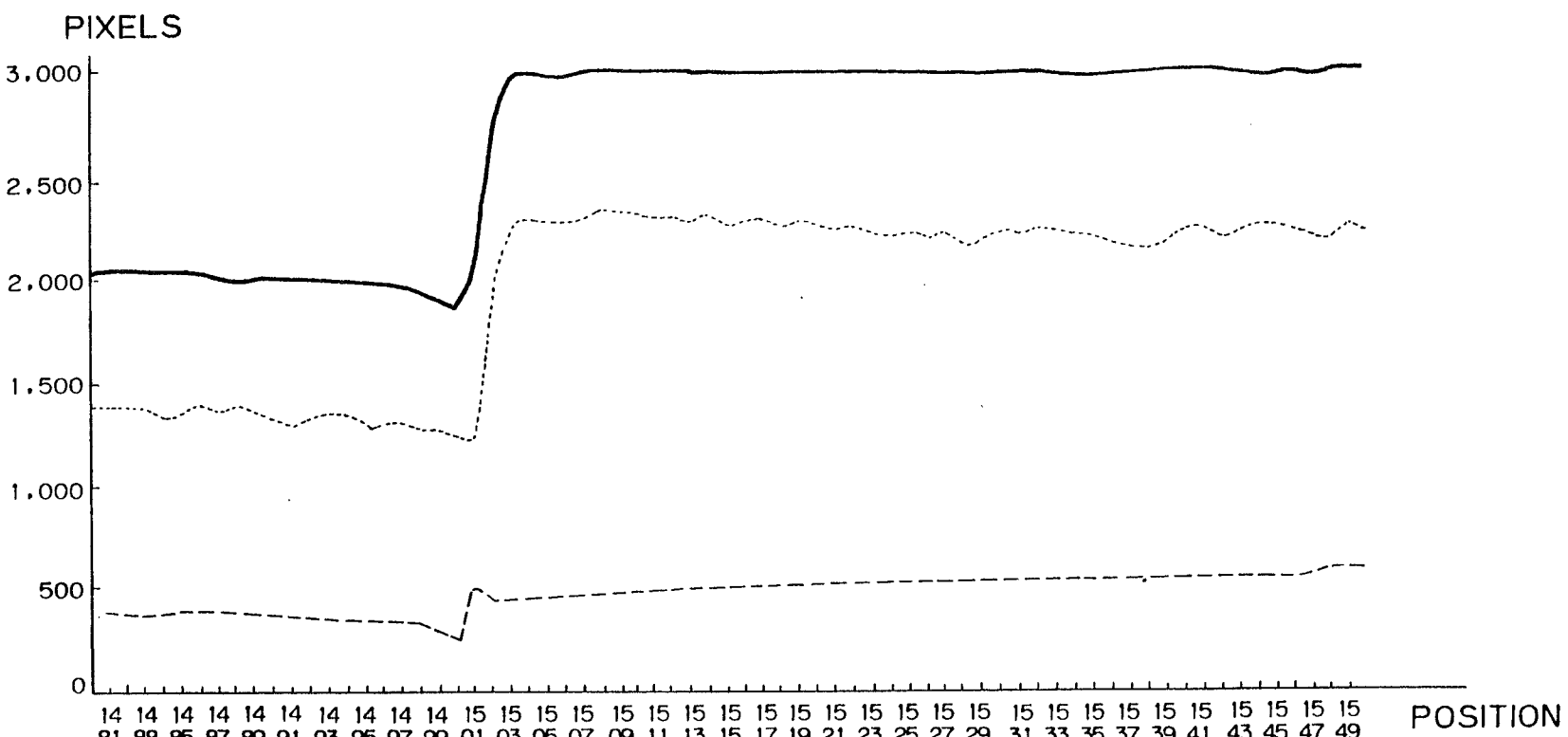
Fig. 3 PRIOR ART
FIG. 3 is graph similar to FIG. 2, showing the relation with respect to a threshold greater than 25.

More specifically, FIG. 2 shows a relation between the number of pixels on one line which are greater than a thresholdd 32 and located in the vicinity of the boundary between a document and a platen cover and the position in the subscanning direction. In FIG. 2, there is shown the number of pixels greater than a predetermined threshold (6 bits and tone 46) per line (1000 pixels) as counted in the neighborhood of a certain document and a platen cover whose inner surface resembles a mirror surface. Such a number of pixels is determined with each of different document thicknesses. In the figure, 1500y on the X axis is representative of the boundary. When the specific threshold is 32 as shown in FIG. 2, hardly any difference occurs between the document portion and the cover portion with respect to the number of pixels greater than the threshold, except for the thickness of 0 mm. On the other hand, as shown in FIG. 3, when the threshold is reduced to 25, the document portion and the cover portion are noticeably different from each other with respect to the above-mentioned number of pixels, whatever the thickness may be. That is, the threshold level has to be lowered in matching relation to the density of the platen cover which changes with the thickness of the document. For example, when the threshold is lowered from 32 to 25, a document of the kind having an edge whose density is 32-26 cannot be sensed at all.

Figure 4:
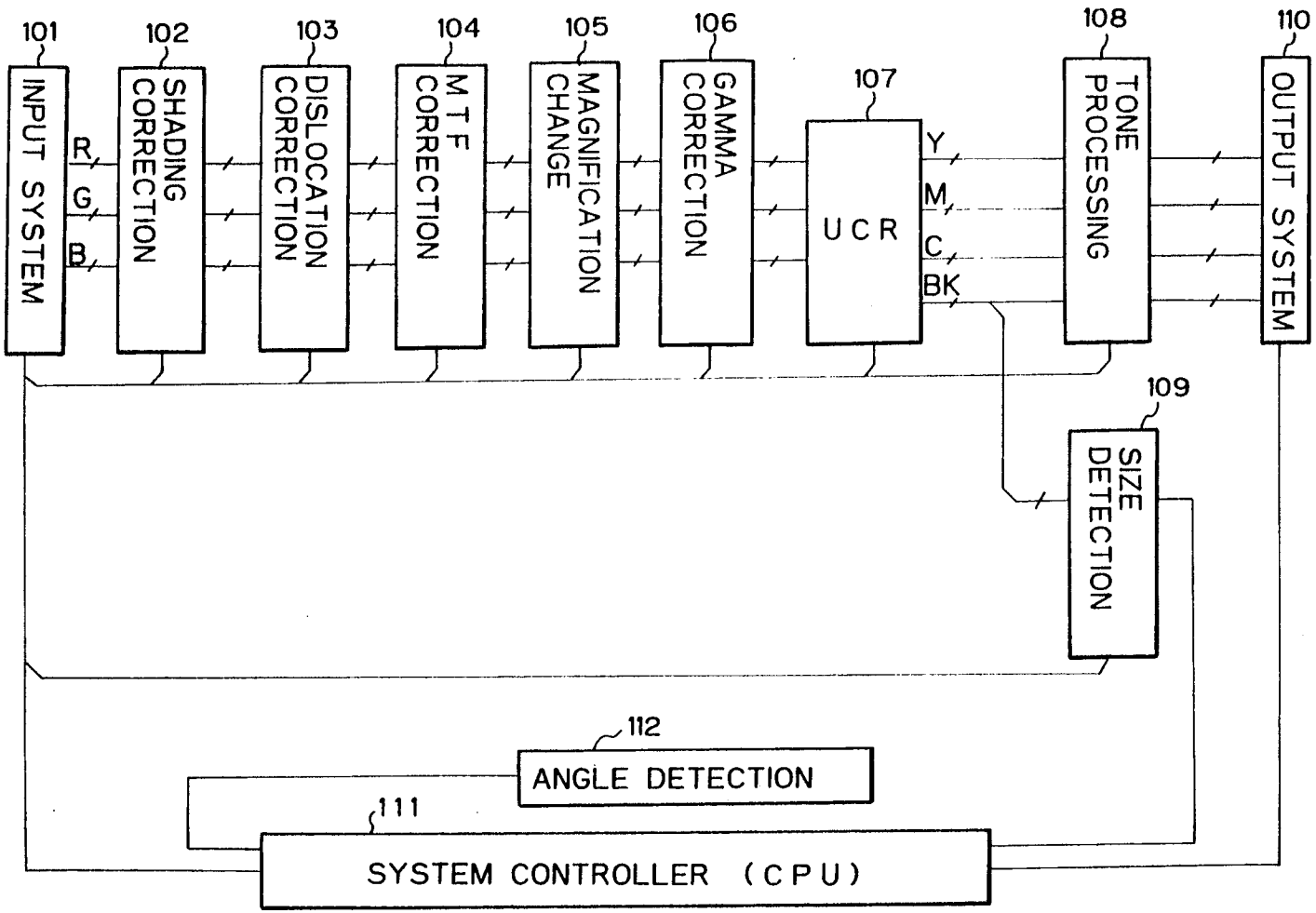
FIG. 4 is a block diagram schematically showing an image processing system included in a copier embodying the present invention.

Referring to FIG. 4, a copier embodying the present invention, particularly an image processing system thereof, is shown. As shown, the image processing system has an input system 101 for converting and analog image signal fed thereto from a CCD image sensor or similar image sensor to R, G and B signal representative of red, green and blue, respectively. The input system 101 is connected to a shading correction circuit 102 which compensates for the scattering of sensitivity among the pixels of the image sensor as well as ireregularities in illumination. The shading correction circuit 102 is connected to a dislocation correction circuit 103. Cascaded to the dislocation correction circuit 103 are a modulation transfer function (MTF) correction circuit 104 for correcting MTF, a magnification change circuit 105 for executing magnification change processing, a gamma correction circuit 106 for correcting the amplification rate of the contrast between the center and the ends of density width, and an undercolor removal (UCR) circuit 107 which removes gray components from yellow (Y), magenta (M) and cyan (C) to replace the latter with black (BK). The UCR circuit 107 is connected to a tone processing circuit 108 for converting each of Y, M, C and BK data to multilevel data, and a size detection circuit 109 for determining the size of a document on the basis of the density of black data BK. Further, the tone processing circuit 108 is connected to an output system 110. The circuits 101-110 are controlled by a system controller 111 including a central processing unit (CPU). An angle detection circuit 112 is connected to the system controller 111.

Figure 5:
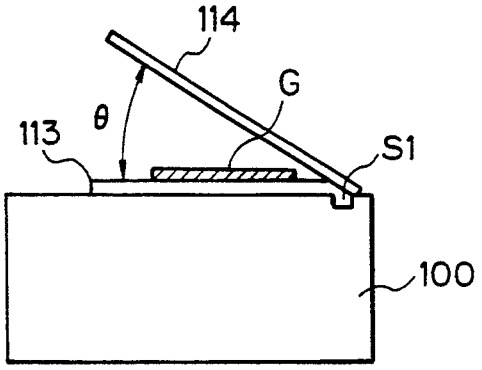
FIG. 5 is an elevation showing a sensor S1 included in the embodiment.

As shown in FIG. 5, a glass platen, or simply platen, 113 is mounted on the top of the copier body 100 while a platen cover 114 is openably hinged to the copier body 100. The angle detection circuit 112 has a sensor S1 capable of sensing the density of a mirror surface formed on the side of the platen cover 114 that faces a document G, so long as the angle $\theta$ of the platen cover 114 relative to the platen 113, i.e., the inclination angle $\theta$ of the platen cover 114 lies in the range from 0 degrees to 90 degrees. Specifically, the sensor S1 is positioned in close proximity to the position where the platen cover 114 is hinged to the copier body 100, sensing the density of the mirror surface which changes with the inclination angle $\theta$. The angle detection circuit 112 converts the density of the mirror surface sensed by the sensor S1 to an inclination angle of the platen cover 114 and feeds it to the system controller 111.

In an ordinary copying operation, after the document G has been laid on the platen 113, a print button provided on the copier body 100 is pressed. Then, a scanner incorporated in the copier body 100 starts illuminating the document G. The resulting image information is transformed to three primary-color signals R, G and B by the input system 101. The color signals R, G and B each sequentially undergoes shading correction, dislocation correction and MTF correction executed by the circuits 102, 103 and 104, respectively. Further, each color signal R, G or B is subjected to magnification change processing, gamma correction and color correction by the circuits 105, 106 and 107, respectively. Subsequently, image data Y, M, C and BK which the tone processing circuit 108 produces from the outputs of the UCR circuit 107 are each transformed to multilevel data and fed out via the output system 110.

Figure 6:
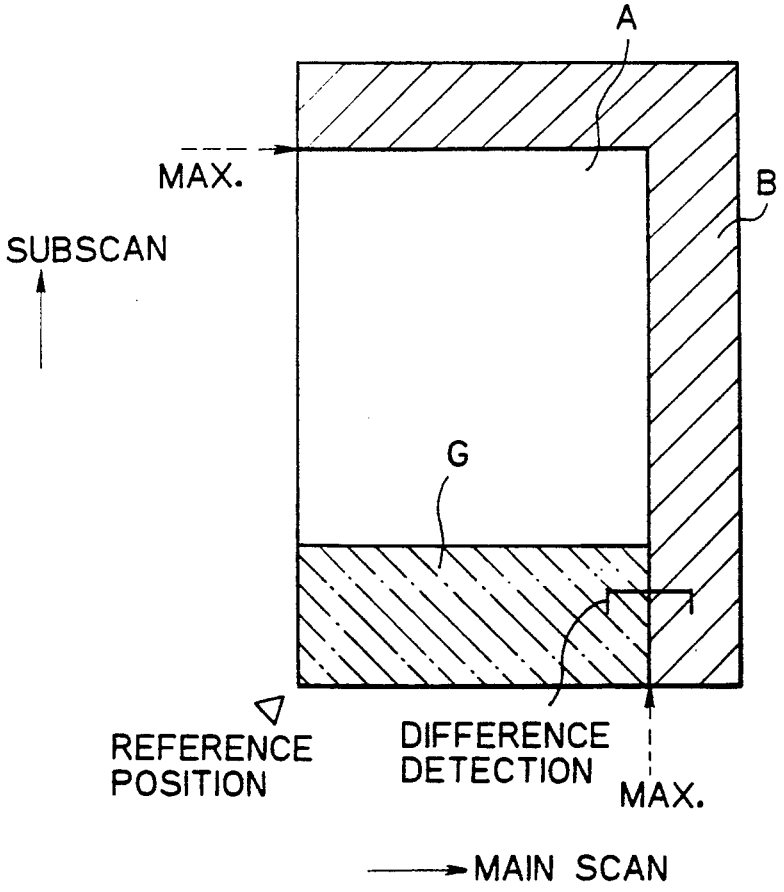
FIG. 6 is a plan view showing an effective image area and the outside of the same.

To detect the size of the document G, the illustrative embodiment performs prescanning to use the resulting BK signal. Assume that the document G of maximum size in the main or subscanning direction is laid in an effective area, e.g., the document G is laid in an effective area A, FIG. 6, such that it coincides with the maximum value of the area A in the main scanning direction. Then, the area for producing a difference in density between the platen cover 114 and the document G is not available in the effective area, preventing the document G of maximum size from being detected. In light of this, this embodiment provides the size detection circuit 109 with an outside data generating section 202 which will be described in detail later. The outside data generating section 202 generates data equal in density to the mirror surface of the platen cover 114 as data representative of an area B outside the effective image area A. At this instant, the prerequisite is that the data generated by the outside data generating section 202 be identical with the data associated with the mirror surface of the platen cover 114. Since the data representative of the mirror surface changes with the inclination angle $\theta$ of the platen cover 114, the illustrative embodiment satisfies the above requirement by changing the parameter which the document size detection circuit 109 uses and changing the mirror surface data meant for the area B in matching relation to the angle $\theta$.

On the other hand, the inclination angle $\theta$ determined by the angle detection circuit 112 is applied to the system controller 111. The system controller 111 has a memory thereinside which stores a parameter table associated with various inclination angles $\theta$. A specific parameter table is shown in FIG. 7. On receiving an inclination angle $\theta$, the system controller 111 selects a particular parameter (one of parameters I–IV) and feeds it to the size detection circuit 109. The parameters I–IV are as follows:

(a) parameter I: difference X (b) parameter II: threshold (greater than document data and equal to or smaller than cover data)

(c) parameter III: difference Y (fixed value "1000" in the embodiment)

(d) parameter IV: inclination angle $\theta$

Figure 8:
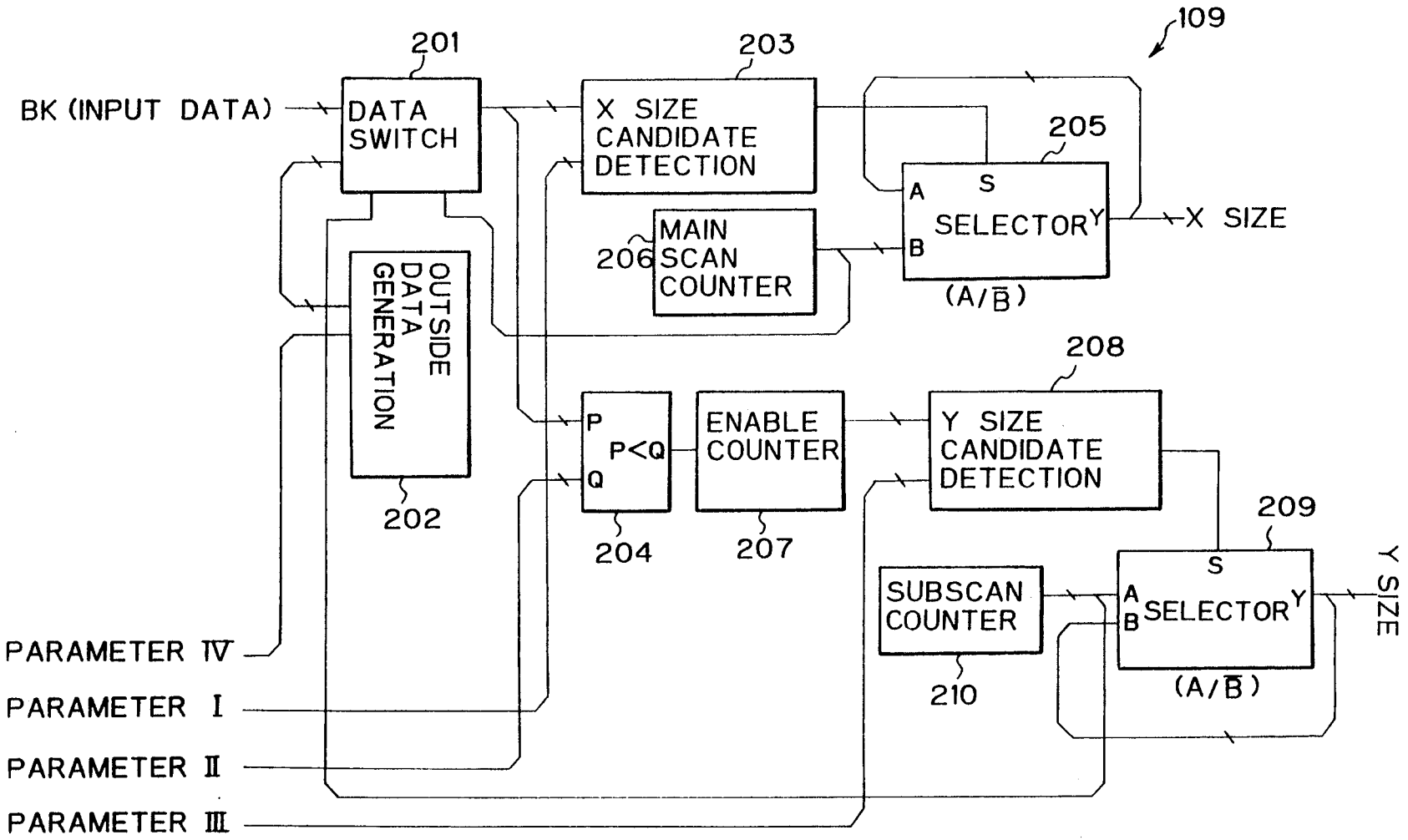
FIG. 8 is a block diagram schematically showing a specific construction of a size detection circuit also shown in FIG. 4.

FIG. 8 shows a specific construction of the size detection circuit 109. As shown, the circuit 109 has a data switching section 201 to which the black data BK is applied. The data switching section 201 is connected to the outside data generating section 202, an X size candidate detecting section 203, and a comparator 204. The parameter IV, i.e., inclination angle $\theta$ is applied to the outside data generating section 202 while the parameter I is applied to the X size candidate detecting section 203. The parameter II is fed to the Q terminal of the comparator 204. The output of the candidate detecting section 203 is connected to a selector 205. A main scan counter 206 has the output thereof connected to the selector 205 and to the data switching section 201. An enable counter 207, a Y size candidate detecting section 208 and a selector 209 are cascaded to the comparaor 204. The output of a subscan counter 210 is connected to the selector 209. The parameter III, i.e., the fixed value "1000" is applied to the Y size candidate detecting section 208.

The operations of the major sections included in the circuitry of FIG. 8 are as follows.

Figure 9:
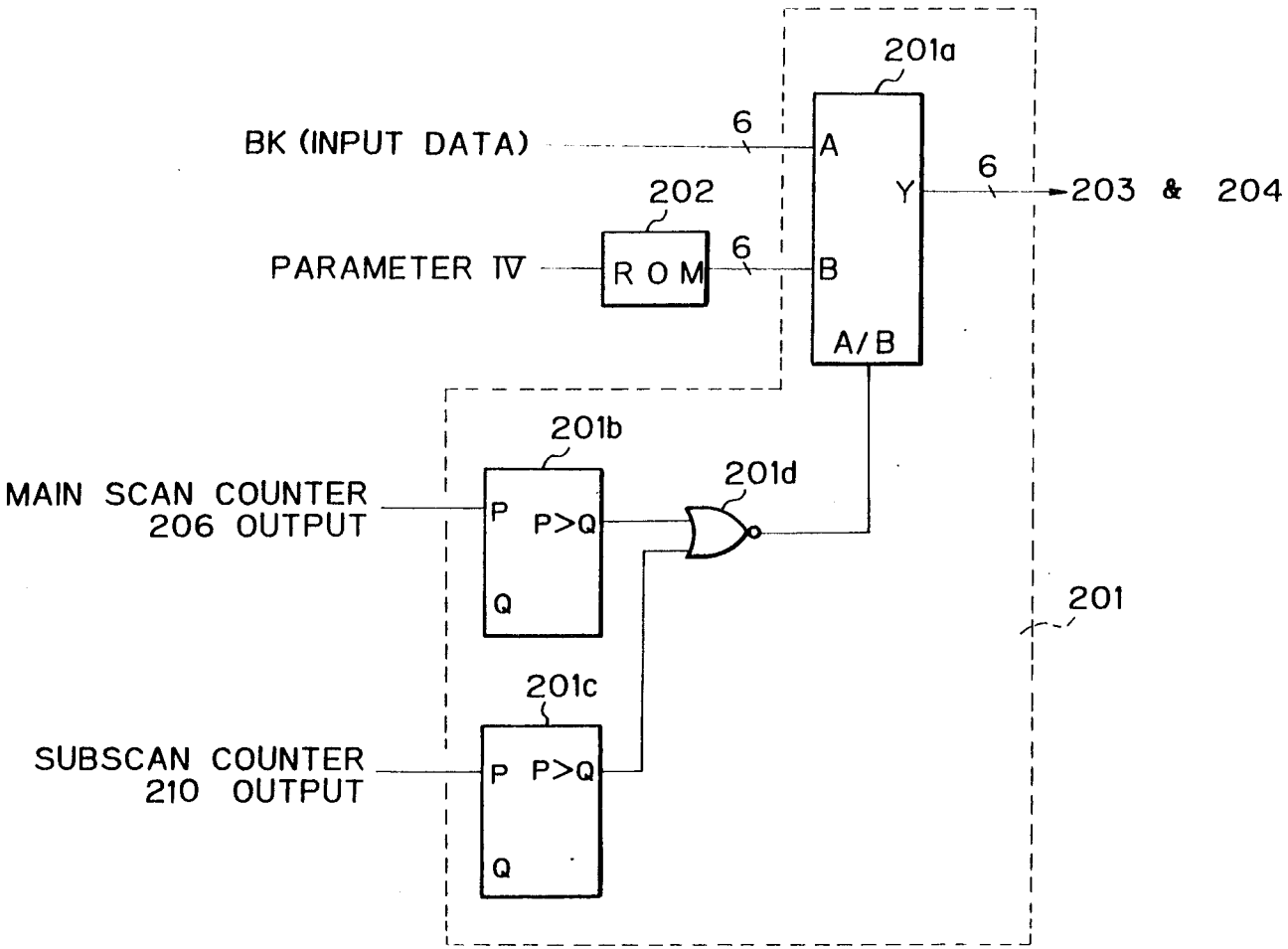
FIG. 9 is a block diagram schematically showing a specific construction of a data switching section shown in FIG. 8.

The data switching section 201 selects either one of document data from the scanner or the data from the outside data generating section 202. FIG. 9 shows the data switching section 201 in detail. When the output of the main scan counter 206 or that of the subscan counter 210 exceeds the maximum size accommodatable in the effective area, the output of a comparator **201*b* (or 201*c*) changes from a low level or "L" to a high level or "H". Here, the maximum accommodatable sizes in the main and subscanning directions are set on the Q terminals of the comparators 201*b* and 201*c*, respectively. As a result, an OR gate 201*d* produces a low level output. In response, a selector 201*a* selects data B. The outside data generating section 202 delivers data associated with the inclination angle $\theta$ (parameter IV) determined by the detection circuit 112 to the selector 201 as the data B. Therefore, data set in the outside data generating section 202 beforehand may be generated for the area B outside of the effective area A. In this embodiment, the outside data generating section 202** is implemented as a ROM and stores outside area data each being associated with a particular inclination angle $\theta$.

Figure 1:
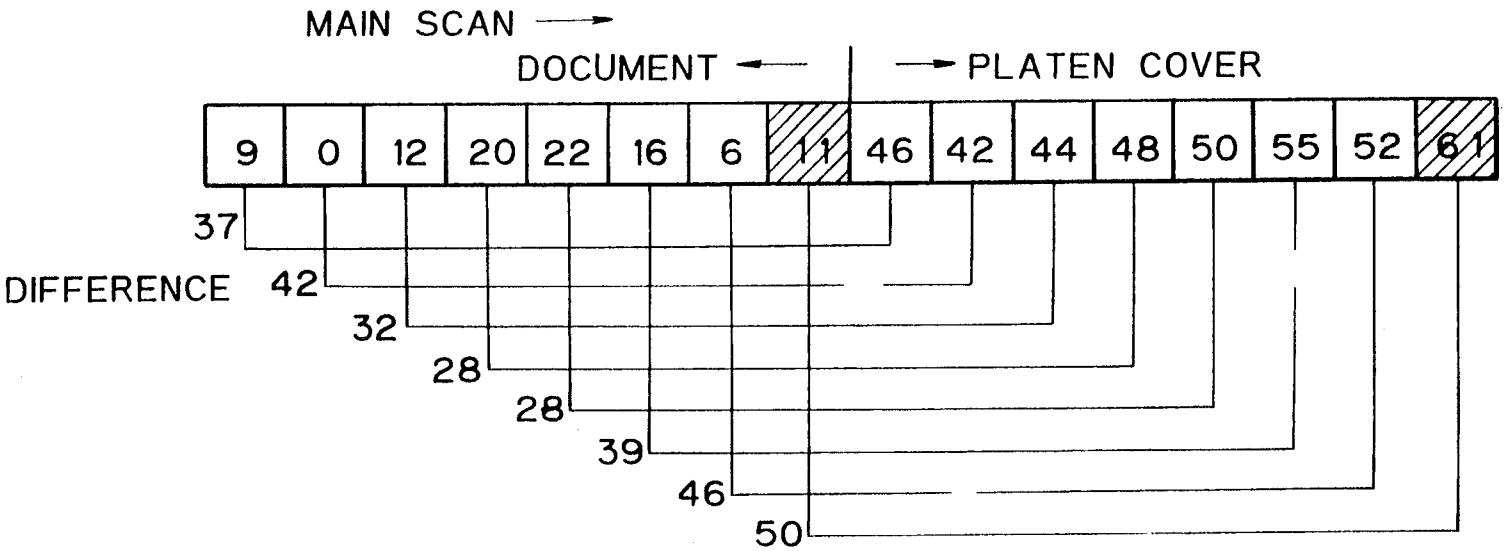
Fig. 1 PRIOR ART
FIG. 1 shows how a document laid on a platen and a platen cover may be discriminated from each other to determine the size of the document.

The X size candidate detecting section 203 detects the differences shown in FIG. 1, it determines a difference between data which are remote from each other by a predetermined distance. When the detecting section 203 determines that a condition wherein a difference greater than the parameter I has continuously occurred a predetermined number of times, it delivers a high level signal to the selector 205. The resulting output "H" of the selector 205 is fed back to the input terminal (A terminal) of the same. Consequently, the selector 205 selects the output of the main scanning counter 206 to update the X size. As the comprator 204 feeds a result of comparison of the input data and parameter II to the enable counter 207, the enable counter 207 counts the number of pixels where P is smaller than Q in one raster. When the Y size candidate detecting section 208 determines that a condition wherein a difference between the outputs of the enable counter 207 which are remote from each other by predetermined rasters has continuously occurred over a predetermined number of rasters, it delivers a high level signal to the S terminal of the selector 209. In response, the selector 209 selects the B terminal thereof and delivers the current subscanning address on the Y terminal as a Y size.

The general operation of the circuitry shown in FIG. 8 will be described hereinafter, the detection of the X size being first. The X size candidate detecting section 203 determines a difference between data which are remote from each other by a predetermined number of pixels. When a condition wherein a difference greater than the parameter I continues over a predetermined number of pixels, such pixels are dealt with as candidates. The greatest one of such candidates in one raster is memorized. If the greatest value in the current raster is greater than the value having been stored in the preceding raster, the value is updated. Finally, therefore, the greatest one of the candidates detected in all the rasters is determined to be the X size of the document. Regarding the Y size, the Y size candidate detecting section 208 also determines differences. Specifically, the enable counter 207 counts data on one line which are greater than the threshold (parameter II). The output of the enable counter 207 is stored over a predetermined number of lines. When a condition wherein the difference between the counts which are remote from each other by several lines is greater than III continues over a predetermined number of lines, the current point is determined to be the candidate. In the case of Y size, the data is updated every time a candidate appears. The X size and the Y size determined at the end of prescanning are sent to the system controller 111 as a document size.

A frequency dividing counter may be used to divide a pixel clock to $\frac{1}{2}$, $\frac{1}{4}$, $\frac{1}{8}$, or similar value, if desired. Such a value may be entered on an operation board, not shown. So dividing a pixel clock is successful in coping with noise ascribable to the contamination of the platen cover 114 and, therefore, in enhancing accurate detection. This is especially true with a platen cover having been used over a long period of time. Since the discrimination between the inside and the outside of a document cannot be made when the inclination angle $\theta$ of the platen cover 114 exceeds 40 degrees, an alarm may be produced when the angle $\theta$ is greater than 40 degrees so as to inform the operator of the fact that the copier cannot detect the document size.

In summary, it will be seen that the present invention provides a copier which is capable of surely detecting the size of a relatively thick document with no regard to the position of a platen cover thereof. In addition, the copier of the invention is inexpesive since it is operable with light of the kind consuming a minimum of power.

Various modifications will become possible for those skilled in the art after receiving the teachings of the present disclosure without departing from the scope thereof.

What is claimed is:

1. A copier having a platen for laying a document thereon and a platen cover having the inner surface thereof implemented as a mirror surface or similar reflective surface for covering said platen and said document, and capable of detecting the size of said document by illuminating said reflective surface of said platen cover and said document, reading the resulting reflections from said platen cover and said document, and discriminating said platen cover and said document on the basis of read data representative of said reflections, said copier comprising:

angle detecting means for detecting an inclination angle of said platen cover relative to said platen; and parameter setting means for changing, in response to the detected inclination angle, a parameter to be used for the detection of a document size.

2. A copier as claimed in claim 1, wherein said parameter comprises a threshold associated with a difference between said data read from document and said platen cover.

3. A copier as claimed in claim 2, wherein said threshold decreases with the increase in the inclination angle of said platen cover relative to said platen.

4. A copier as claimed in claim 1, wherein when the size of said document in either one of a main scanning and a subscanning exceeds an effective readable area, a predetermined value is used as data for an area outside of said effective readable area.

5. A copier as claimed in claim 4, wherein said predetermined value is changed in matching relation to the inclination angle of said platen cover relative to said platen.

6. A copier as claimed in claim 5, wherein said predetermined value decreases with the increase in the inclination angle of said platen cover relative to said platen.

* * * * *